United States Patent [19]

Ennerdal

[11] 4,353,151

[45] Oct. 12, 1982

[54] BUCKLE FOR A SAFETY BELT FOR VEHICLES

[76] Inventor: Leif Ennerdal, Glimmergatan 16, 441 00 Alingsås, Sweden

[21] Appl. No.: 193,262

[22] PCT Filed: Aug. 14, 1979

[86] PCT No.: PCT/SE79/00171

§ 371 Date: Apr. 15, 1980

§ 102(e) Date: Apr. 14, 1980

[87] PCT Pub. No.: WO80/00404

PCT Pub. Date: Mar. 20, 1980

[51] Int. Cl.[3] ..... A44B 11/25

[52] U.S. Cl. ..... 24/230 A

[58] Field of Search ..... 24/230 A, 230 AP, 230 AV

[56] References Cited

U.S. PATENT DOCUMENTS 4,096,606 6/1978 Stephenson ..... 24/230 A 4,182,008 1/1980 Pouget ..... 24/230 A

*Primary Examiner*—David H. Corbin

[57] ABSTRACT

The invention relates to a buckle for a safety belt for vehicles comprising a tongue-shaped insertion part (1) and a sleeve-shaped receiving part (2), a primary lock (10) being provided in the receiving part, which lock is pivoted on a shaft (9), which is parallel to the plane of the insertion part and perpendicularly arranged relative to the direction of insertion of said insertion part, the primary lock exhibiting one or several projections, which cooperate with corresponding stop dogs (11) on the insertion part. According to the invention the primary lock comprises a double armed lever, of which the end located nearest to the insertion opening of the receiving part, i.e. one of its arms exhibits said stop dog (11) cooperating with the insertion part (1) and of which lever the arm extending in opposite direction cooperates with a secondary lock (18), which tends to maintain the primary lock in its engaging position, the secondary lock against the bias of a spring being displaceable substantially in the longitudinal direction of the arm belonging to the primary lock into a position, in which the arm can freely pivot towards the neutral position of the primary lock.

10 Claims, 10 Drawing Figures

BUCKLE FOR A SAFETY BELT FOR VEHICLES

The present invention relates to a buckle for a safety belt for vehicles, which comprises a tongue-shaped insertion part and a sleeve-shaped receiving part exhibiting a locking means, hereinafter called "the primary lock", which is provided for locking the insertion part, when it is in an inserted position in the receiving part, and for permitting its release from such a locked condition, the primary lock being designed as an arm, which is pivotable round a shaft, which is parallel to the plane of the insertion part and perpendicularly arranged relative to the direction of movement of the insertion part in the receiving housing, which primary lock is provided with one or several engaging pins serving the purpose in a first pivoting position (locking position) to cooperate with a counter pin on the insertion part and lock the same to the receiving part, and in a second pivoting position to release the insertion part, the primary lock being spring loaded in the releasing direction and provided with a stop dog, which is in cooperation with a locking means displaceable along the stop dog, hereinafter called "the secondary lock", arranged to impede the primary lock from pivoting in the releasing direction into a displacing position (locking position) of the secondary lock, whereas the secondary lock permits pivoting of the primary lock into a second position of displacement (release position) of the secondary lock, said primary and secondary locks for the purpose of releasing the locking mechanism being actuated by a manually operated device, which can be displaced in the direction of insertion of the inserting part.

It is a principal object of the invention to provide a reliably functioning means of the kind mentioned, which is of as simple design as possible.

Said purpose is reached by the invention, which substantially is characterized by the primary lock comprising a double armed lever, i.e. a lever extending on both sides of said pivoting shaft, the one arm of said lever, which is pointing in outwards direction, i.e. in direction towards the opening of insertion, supporting said stop dog, which cooperates with the insertion part, and the inwards pointing arm of said lever supporting said stop dog cooperating with the secondary lock, which last mentioned stop dog is formed by a surface, which is facing in the same direction as the direction, in which the projection supporting the stop dog cooperating with the insertion part is projecting.

Figure 1:
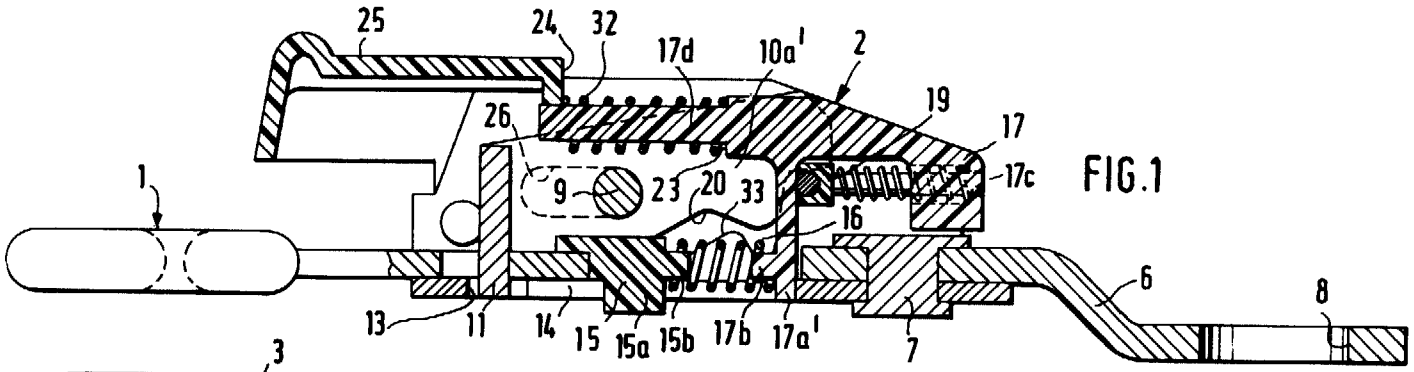
Figure 2:
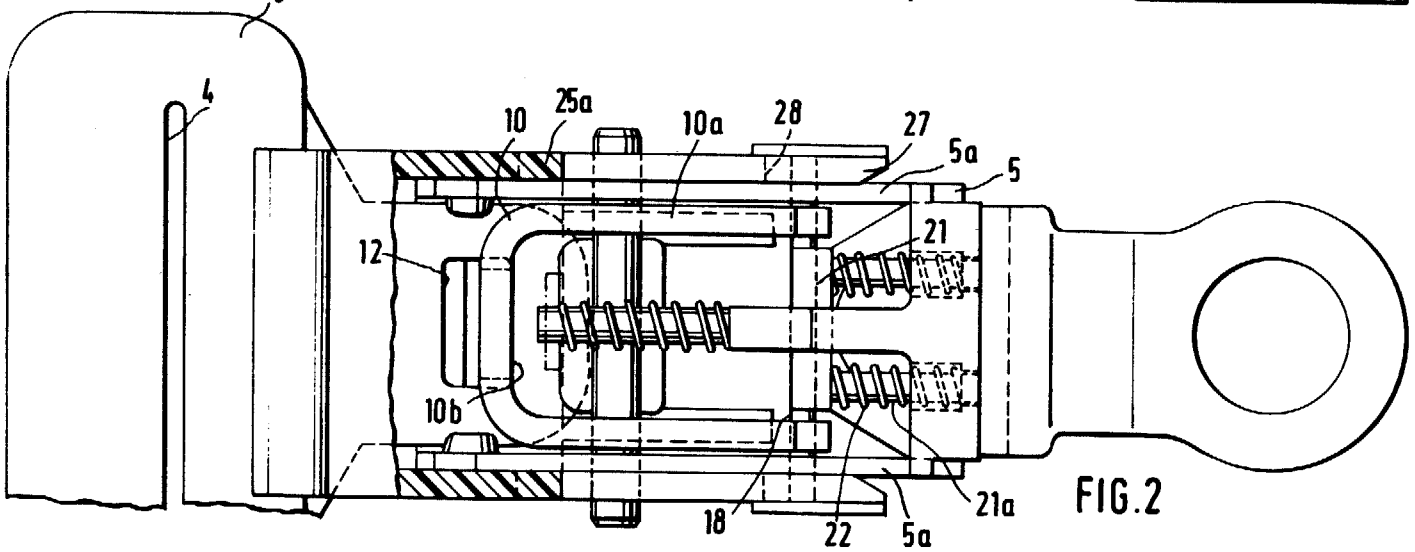
Figure 3:
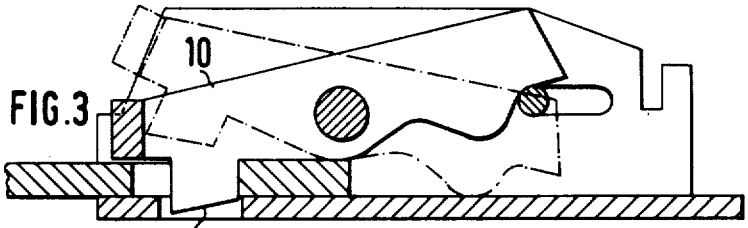
Figure 4:
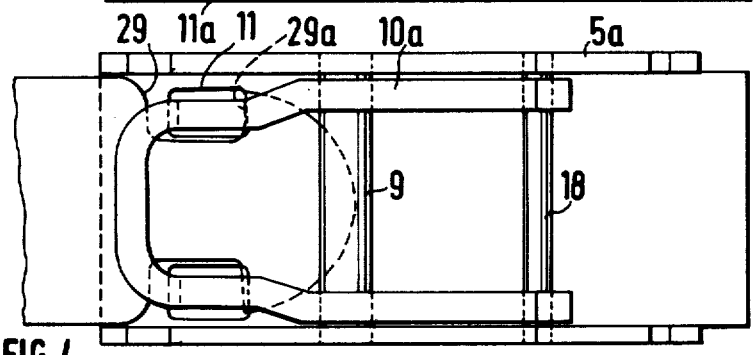
Figure 5:
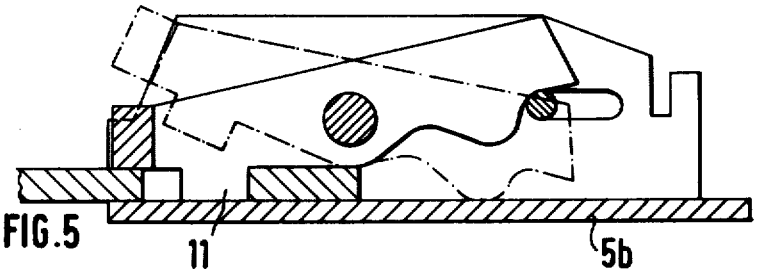
Figure 6:
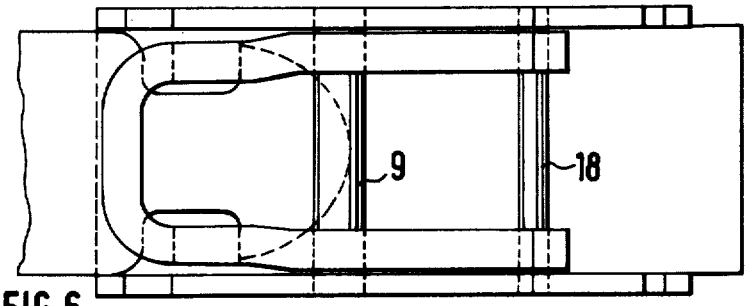
Figure 7:
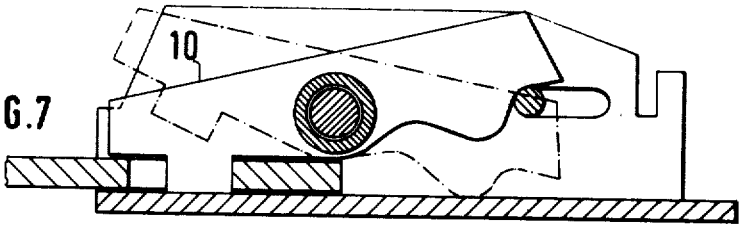
Figure 8:
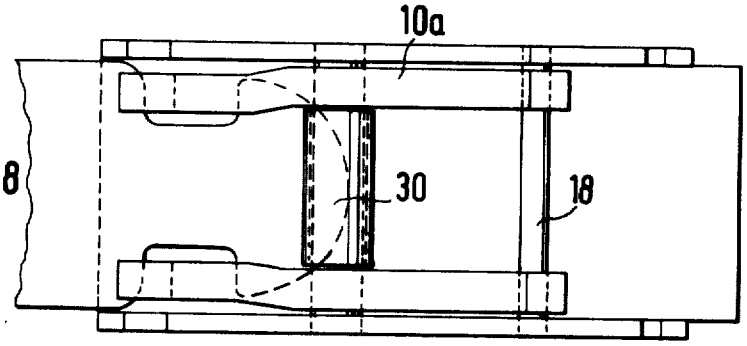
Figure 9:
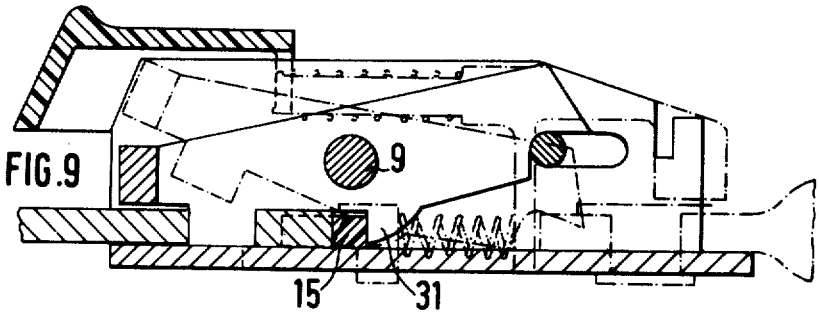

The invention is described in the following, reference being made to the accompanying drawings, in which FIG. 1 is a view of a longitudinal cross section through a buckle designed according to the invention, FIG. 2 is a partly sectional view of the same buckle as seen from above in FIG. 1, FIG. 3 is a view substantially corresponding to the one in FIG. 1 and schematically showing a longitudinal cross section through a variant of a buckle designed according to the invention, FIG. 4 is a view substantially corresponding to the one of FIG. 2 and schematically showing a top view of the buckle illustrated in FIG. 3, FIG. 5 is a view corresponding to the one in FIG. 3 and showing a longitudinal cross section through a buckle according to another variant of embodiment, FIG. 6 is a view corresponding to the one of FIG. 4 and showing the buckle illustrated in FIG. 5, FIG. 7 is a view corresponding to the one of FIG. 3 and showing a longitudinal cross section through a buckle of still another variant of embodiment according to the invention, FIG. 8 is a view corresponding to the one of FIG. 4 and showing the buckle illustrated in FIG. 7, FIG. 9 is a view corresponding to the one of FIG. 7 and showing a longitudinal cross section through a buckle designed according to still another variant of embodiment of the invention, and FIG. 10 finally being a view corresponding to the one of FIG. 8 and showing the buckle illustrated in FIG. 9.

The buckle, which is illustrated in FIGS. 1 and 2, comprises a tongue-shaped insertion part, in its entirety indicated with 1, and a sleeve-shaped receiving part, which in its entirety is indicated with 2. In the illustrated embodiment the insertion part exhibits a loop-shaped portion 3 with a slit-shaped opening 4, through which a band forming part of a safety belt is intended to be threaded. The receiving part exhibits a frame 5, which is made of a piece of a steel sheet bent into the shape of a chute of U-shaped cross section. The lateral walls of the chute are indicated with 5*a* and its bottom portion with 5*b*. At the end of the frame 5 facing away from the insertion side a projecting piece 6 of sheet metal for mounting purpose is riveted to the frame by means of a rivet 7 passing through the mounting piece and the bottom portion of the frame 5*b*. The mounting piece is provided with a loop-shaped end portion, the hole 8 of which is inteded to take up a bolt for the mounting of the receiving part on the body or to any other suitable part of the vehicle in question. It is of course also within the scope of the invention to attach the receiving part to the vehicle in any other manner than directly by means of a mounting piece of sheet metal. It is of course possible also to suspend the receiving part at one end of a band. It can also be imagined to mount the receiving part to the vehicle via a flexible bar or similar. A shaft 9 extends parallel to the bottom portion 5*b* of the frame and perpendicularly to the direction of insertion of the insertion part, which direction is to the right according to the drawing. A locking means pivoted on the shaft pivot 9 is indicated with 10 and intended to maintain the insertion part in a position, in which it is locked to the receiving part, which is the position illustrated in FIGS. 1 and 2. The locking means 10, which hereinafter is called "the primary lock", is made of a piece of sheet steel bent into U-shape, as is best evident from FIG. 2, and its lateral legs 10*a* exhibit the shape of double armed levers, which are traversed by the shaft pin 9, which, thus, constitutes the pivoting centre of the levers. The middle portion 10*b* of the primary lock according to the FIG. 1 exhibits a downwards pointing projection 11, which cooperates with an opening 12 of the nose portion of the insertion part. The projection 11 extends further down through a hole 13 in the bottom portion 5*b* of the frame. The hole 13 to the right according to FIG. 1 blends into a second slit-shaped hole 14, which extends to the inner portion of the receiving part. The slit-shaped hole 14 forms a guide for a downwards projecting pin-shaped portion 15*a* of an ejection body 15 sliding on top of the bottom portion 5*b*, which ejection body in addition exhibits a pin 15*b* surrounded by one of the end portions of a pressure spring 16. The other end of the spring rests against a downwards projecting finger 17*a* of a yoke piece 17, which with its upper portion extends between the two lateral walls 5*a* of the frame and with projections 17*b* pointing in opposite directions is held according to FIG. 1 in corresponding in upwards direction open border recesses of the lateral walls 5*a*. In order to guide the pressure spring 16 the finger 17*a* in addition exhibits a pin 17*a'* projecting into the end portion of the spring. An additional shaft pivot parallel to the shaft pivot 9 is indicated with 18 and extends through and past the walls 5*a* of the frame. The shaft pivot 18 is in the following called "the secondary lock" because of its locking function in cooperation with a downwards facing stop face 19 of the inwards projecting arm portion 10*a'* of each one of the lateral pieces of the primary lock. The arm piece 10*a'* in addition exhibits a downwards facing guiding surface 20, which cooperates with a cam 33 of the ejector device, which is movable against the bias of the spring 16 to the right according to the drawing, thus away from the illustrated position. The secondary lock 18 is gripped by a sleeve-shaped holder 21, which is provided with two in between them parallel guide pins 21*a*, which extend into corresponding bores 17*c* of the rear portion of the yoke piece. Two pressure springs 22 extend between the yoke piece and the holder 21, which springs surround each one its guide pin 21*a* and tend to move the secondary lock into the illustrated position, in which it bears against the downwards projecting finger 17*a* of the yoke piece. The possible path of movement of the secondary lock is so long that against the bias of the springs 22 it can be moved out of its engagement with the stop dog edges 19, whereby the primary lock is permitted to pivot in clockwise direction according to FIG. 1, i.e. out of its engagement with the nose portion of the insertion part 1. The yoke piece moreover exhibits a projecting finger 17*d*, which is surrounded by a pressure spring 32, one end of which rests against a stop dog 23 of the yoke piece, while its other end rests against a stop dog 24 of an operating element 25, which is provided with fork-shaped lateral pieces 25*a* arranged on the outside of and parallel to the lateral pieces 5*a* of the frame. The shaft pin 9 extends through oblong slits 26 of the lateral pieces 25*a* of the operating element. The lateral pieces 25*a* of the operating element are near to their free end portions provided with guiding grooves 27, into which the pin 18 of the secondary lock is extending with its end portions. The guiding grooves 27 terminate with a stop edge 28. The shaft pin 9 is placed at a distance from and above the nose portion of the insertion part, which means that the moment arising, when the primary lock 10 is released and the ejector body 15 under the bias of the spring tends to eject the insertion part, produces a forced pivoting of the primary lock in clockwise direction according to FIG. 1, i.e. out of its engaging position with the opening 12 of the nose of the insertion piece. The insertion part instead of its central opening 12 can of course be provided with recesses in both its lateral borders, which of course means that the central projection 11 of the primary lock must be substituted by two projections provided on the sides and cooperating with the lateral recesses of the insertion part.

When the operating element 25 against bias of the pressure spring 22 is moved in direction to the right according to the drawing, the stop dog edges 28 reach a bearing contact against the secondary lock 18, which during a continued movement against bias of the pressure springs 22 is brought out of its engagement with the stop dog edges 19 of the primary lock, which means that the primary lock is no longer locked in the illustrated locking position. The ejector body 15, which under bias of the spring 16 all the time tends to eject the insertion part, then pivots the primary lock in clockwise direction, i.e. its projection 11 moves upwards according to FIG. 1 and emerges out of its engagement with the stop dog opening 12 of the insertion part, whereby a complete ejection of the insertion part takes place. Thereafter the primary lock is held in its free position by the stop dog of the ejector body 15 striking against the backside of its intermediate piece 10*b*. When the insertion part 1 with its nose portion again is inserted into the receiving part, the stop dog of the insertion part reaches contact with the ejection body 15, which during a continued movement inwards of the insertion part against bias of the spring 16 on account of cooperation between the cam 33 and the sliding surface 20 of the primary lock forces the latter one to pivot in counterclockwise direction according to FIG. 1 and thus to return to the position illustrated in the drawing, in which the secondary lock 18 under bias of the pressure springs 22 returns into its engaging grip with the stop dog edge 19 of the primary lock, which thus again is locked in its locking position, in which it holds the insertion part until the operating element 25 is again activated.

In the schematic FIGS. 3 and 4 an embodiment is shown, which finds an application in connection with the insertion parts with the above by way of example mentioned lateral recesses 29 instead of the central hole 12 provided on the insertion part according to the preceding example. This means that the primary lock 10 is instead provided with two projections 11 arranged in its sides, which projections cooperate with stop dog edges 29*a* of the lateral recesses of the insertion part. The projections 11 moreover exhibit an oblique edge portion 11*a*, which means that the necessary lifting height of the primary lock for its disengagement is reduced compared with the preceding example. Forces, which in this embodiment tend to move apart the lateral legs 10*a* of the primary lock, are taken up by the lateral walls 5*a* of the frame, which means that the primary lock can be made of comparatively thin material. In these figures only such details are shown, which exhibit a variation compared with the preceding embodiment. Other details can be designed substantially identical to those of the preceding example.

In the FIGS. 5 and 6 an embodiment is shown, which substantially corresponds to the embodiment illustrated in FIGS. 3 and 4, but exhibiting the difference that the projection 11 of engagement of the primary lock does not extend downwards through the bottom portion 5*b* of the frame.

The embodiment shown in the FIGS. 7 and 8, as was the case with the embodiments shown in FIGS. 3–6, is intended to be used in connection with insertion parts with recesses in their lateral borders. In this embodiment the primary lock differs from the ones previously described with respect to the intermediate piece, which is lacking in this embodiment, as the leg pieces are corresponded by separate arms 10*a*, which are held at a distance from each other by means of a spacer sleeve 30 extending between them. The spacer sleeve 30 can suitably be rigidly connected with the locking pieces 10*a* in order to coordinate their movement.

Figure 10:
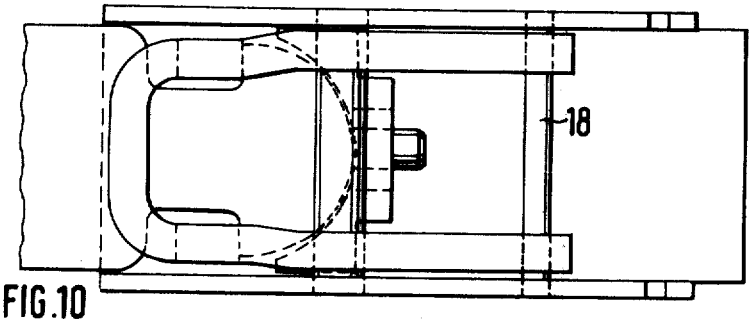

In the embodiment shown in the FIGS. 9 and 10 the cam of the ejection body and the corresponding wedge surface on the primary lock according to the previous embodiments have been substituted by a projection 31 on the primary lock, which bears against the backside of the ejector body 15. At the insertion of the insertion part the primary lock is thus forced into engagement position by cooperation between the ejector body and the projection 31. In this embodiment the ejector body can also impede the primary lock from unintentionally occupying a locking position, when the insertion part is not inserted.

The invention is not limited to the embodiments described above and illustrated in the drawings, but can be varied as to its details within the scope of the following claims without departing from the fundamental idea of the invention. Also combinations of the details forming part of the different examples of embodiment are possible within the scope of the invention.

I claim:

1. In a buckle for a safety belt for vehicles, which comprises a tongue-shaped insertion part and a sleeve-shaped receiving part forming a primary locking means, which is provided for locking the insertion part when it is in an inserted position in the receiving part, and for permitting its release from such a locked condition, the primary locking means being in the form of an arm, which is pivotable around a shaft which is parallel to the plane of the insertion part and perpendicularly arranged relative to the direction of movement of the insertion part in the receiving housing, the primary locking means being provided with at least one engaging pin serving the purpose in a first pivoting locking position to cooperate with a pin on the insertion part and lock the same to the receiving part, and in a second pivoting position to release the insertion part, the primary locking means being spring loaded in the releasing direction and provided with a stop dog which is in cooperation with a secondary locking means displaceable along the stop dog, arranged to impede the primary locking means from pivoting in the release direction into a displacing and locking position of the secondary locking means, whereas the secondary locking means permits pivoting of the primary locking means into a second release position of displacement of the secondary locking means, the release of said primary and secondary locking means being actuated by a manually operated device, which is displaced in the direction of insertion of the insertion part, the improvement wherein the primary locking means comprises a double armed lever pivotable and extending on both sides of said shaft, one arm of said lever, which is directed outwardly toward the opening of insertion supporting said stop dog, which cooperates with the insertion part, and the inwardly directed arm of said lever supporting said stop dog cooperating with the secondary locking means, said last mentioned stop dog being formed by a surface which is faced in the same direction as the direction in which the projection supporting the stop dog cooperating with the insertion part is projected, said secondary locking means comprising a pin spring loaded from the inner portion of the insertion part, said pin being substantially parallel to the shaft of the primary locking means and against bias of said spring actuation by force displaceable past said stop dog cooperating with the same by means of an operating device, which is spring loaded in the same direction, the inner ends of the springs being supported by a common yoke located in the interior portion of the receiving part.

2. A buckle according to claim 1, wherein said yoke also supports the inner end of a pressure spring of an ejector body cooperating with the forward portion of the insertion part.

3. A buckle according to claim 2, wherein the ejector spring is supported by a finger of the yoke projecting downwards towards the guiding path of the insertion part, said yoke also constituting a stop dog for the secondary locking means in its locking position.

4. A buckle according to any one of claims 1–3, wherein the yoke serves the purpose of a sliding guide for the operating device.

5. A buckle according to claim 1, wherein said yoke serves the purpose of a sliding guide for the secondary locking means.

6. A buckle according to claim 5, wherein said sliding guides are formed on guide pins provided on one of the cooperating movable parts, which guide pins extend in corresponding bores in the second part.

7. A buckle according to claim 1, wherein the yoke is detachably connected to the frame of the receiving part.

8. A buckle according to claim 1, wherein one arm of the primary locking means which cooperates with the secondary locking means has a guiding surface cooperating with a cam of a spring loaded ejector member cooperating with the forward portion of the insertion part in such a manner that the primary locking means by sliding cooperation with the cam is forced to occupy its engaging position when the ejector piece is forced to retrograde by the insertion of the insertion part into the receiving part.

9. A buckle according to claim 1, wherein the primary locking means comprises a U-shaped bent piece of sheet metal, the legs of which extend along the sides of the receiving part and through which the shaft of the primary locking means is extended and the middle portion of which is located at the opening end of the insertion part.

10. A buckle according to claim 1, wherein the primary locking means comprises two arms provided at both the longitudinal sides of the receiving part, which arms are maintained at a predetermined distance therebetween by means of a spacer element.

* * * * *